US008708332B2

(12) United States Patent
Cheng

(10) Patent No.: US 8,708,332 B2
(45) Date of Patent: Apr. 29, 2014

(54) AUTOMATIC FEEDING APPARATUS WITH SHEET-INPUT ASSISTING MECHANISM

(71) Applicant: Avision, Inc., Hsinchu (TW)

(72) Inventor: Sung-Po Cheng, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 13/793,103

(22) Filed: Mar. 11, 2013

(65) Prior Publication Data

US 2013/0328261 A1 Dec. 12, 2013

(30) Foreign Application Priority Data

Jun. 6, 2012 (TW) ..... 101120215 A

(51) Int. Cl.
*B65H 3/52* (2006.01)

(52) U.S. Cl.
USPC ..... 271/138; 271/121; 271/131; 271/137

(58) Field of Classification Search
USPC ..... 271/121, 124, 125, 131, 137, 138, 35
See application file for complete search history.

(56) References Cited

U.S. PATENT DOCUMENTS

| | | | | |
|---|---|---|---|---|
| 4,492,315 | A * | 1/1985 | Hooper | 221/186 |
| 5,951,002 | A * | 9/1999 | Yokota | 271/117 |
| 6,367,795 | B1 * | 4/2002 | Matsuda et al. | 271/126 |
| 6,991,227 | B2 * | 1/2006 | Kim | 271/10.12 |
| 7,226,048 | B2 * | 6/2007 | Connors et al. | 271/121 |
| 7,621,522 | B2 * | 11/2009 | Yasukawa et al. | 271/121 |
| 7,832,722 | B1 * | 11/2010 | Huang | 271/121 |
| 8,231,122 | B2 * | 7/2012 | Tu | 271/121 |
| 2007/0108696 | A1 * | 5/2007 | Yorimoto | 271/121 |
| 2008/0203652 | A1 | 8/2008 | Yasukawa et al. | |

FOREIGN PATENT DOCUMENTS

CN 101254864 B 12/2010

* cited by examiner

*Primary Examiner* — Ernesto Suarez

(57) ABSTRACT

An automatic feeding apparatus includes a body and a sheet passage, a sheet-separation mechanism and a sheet-input assisting mechanism in the body. The sheet-separation mechanism is configured to separate sheets. The sheet-input assisting mechanism includes a frame, a presser, a clutch gear and a driving device. The clutch gear, driven by the driving device, is displaceable on a guide groove of the frame between a first position and a second position. The clutch gear is rotated rearward to be engaged with a gear rack of the presser at the first position and thereby drive the presser to move in a first direction. The clutch gear is rotated forward to move to the second position and disengaged from the gear rack of the presser. After being released, the presser moves in a second direction to press a sheet in front of a nip portion of the sheet-separation mechanism.

11 Claims, 8 Drawing Sheets

140

50 { 51, 52 }

140

51 52

50

AUTOMATIC FEEDING APPARATUS WITH SHEET-INPUT ASSISTING MECHANISM

This application claims priority of No. 101120215 filed in Taiwan R.O.C. on Jun. 6, 2012 under 35 USC 119, the entire content of which is hereby incorporated by reference.

BACKGROUND OF THE INVENTION

1. Field of the Invention

The present invention relates to an automatic feeding apparatus with a sheet-input assisting mechanism, and more particularly to a sheet-input assisting mechanism driven by a power source, and an automatic feeding apparatus using the sheet-input assisting mechanism to stabilize the conveyance of sheets.

2. Related Art

In a conventional sheet-fed scanner, if no special device is disposed on a paper supply tray for pinching paper sheets or restricting the drifting thereof (especially for used fluffy, thin sheets), skewing of the paper sheets may occur. Some high-end scanners or printers therefore would have sheet stabilizing and assisting devices or pressers to overcome the problems.

For example, the so-called gravity type presser presses the sheet by its own weight. However, if the presser is too heavy, the thin sheets being pressed will not be able to move forward and advance to the next stage. If the presser is too light, it cannot effectively press the fluffy or thin sheets and cannot prevent or correct the skew.

China Patent No. CN101254864B (also published as US2008/203652) discloses a presser driven by a motor for pressing paper sheets placed on the paper supply tray. The resilient pressing force of the presser, unlike the above-mentioned prior art, is adjustable. However, the design is complicated. The presser is linked to the motor through a plurality of components (including a compression spring, a torsion spring, a rotatable link, and etc.) disposed underneath the paper supply tray and has to cooperate with these components in order to execute the paper pressing function. In such a configuration where many components are used to relay the motor control to the presser, the driving force of the motor cannot be promptly transmitted to the presser and a delay in the execution may thus take place.

SUMMARY OF THE INVENTION

Accordingly, the present invention has been proposed to solve the problems of the prior art, and it is an object of the present invention to provide an automatic feeding apparatus for controlling a presser according to the operating principles of the gear engaging and disengaging.

To achieve the above-identified object, the present invention provides an automatic feeding apparatus including a body and a sheet passage, a sheet-separation mechanism and a sheet-input assisting mechanism in the body. The sheet-separation mechanism, disposed in the body and at an entrance of the sheet passage, is used for sheet separation. The sheet-separation mechanism forms a nip portion. The sheet-input assisting mechanism includes a frame, a presser, a clutch gear and a driving device. The presser, used to press a sheet in front of the nip portion, is mounted on the frame and includes a holder and a gear rack mounted on a side wall of the holder. The clutch gear is supported and displaceable on a guide groove of the frame and is configured to move within the guide groove between a first position and a second position. The driving device selectively drives the clutch gear to rotate forward and rearward. The clutch gear when rotating rearward is engaged with the gear rack at the first position and drives the presser to move in a first direction. The clutch gear when rotating forward is shifted to the second position and disengaged from the gear rack. The presser, after being released by the clutch gear, moves in a second direction to press the sheet.

The present invention utilizes the motor and the gear-rack transmission assembly to drive the presser. The reverse rotation of the clutch gear lifts up the presser from the position where the presser presses the sheets. On the other hand, the forward rotation of the clutch gear enables the clutch gear to slide into a position to break off from the gear rack, and thereby releases the presser. In addition, the energy released by the compression spring is utilized to increase the suppressing force exerted by the presser on the sheets, so that the presser effectively functions. In this invention, the forward and rearward rotation of the clutch gear actuates the engagement and disengagement of the clutch gear and gear rack, and thereby effectuates the movement of the presser, and by this simple mechanism, the presser switches faster between states and less response time is required.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

The present invention will be apparent from the following detailed description, which proceeds with reference to the accompanying drawings.

Figure 1:
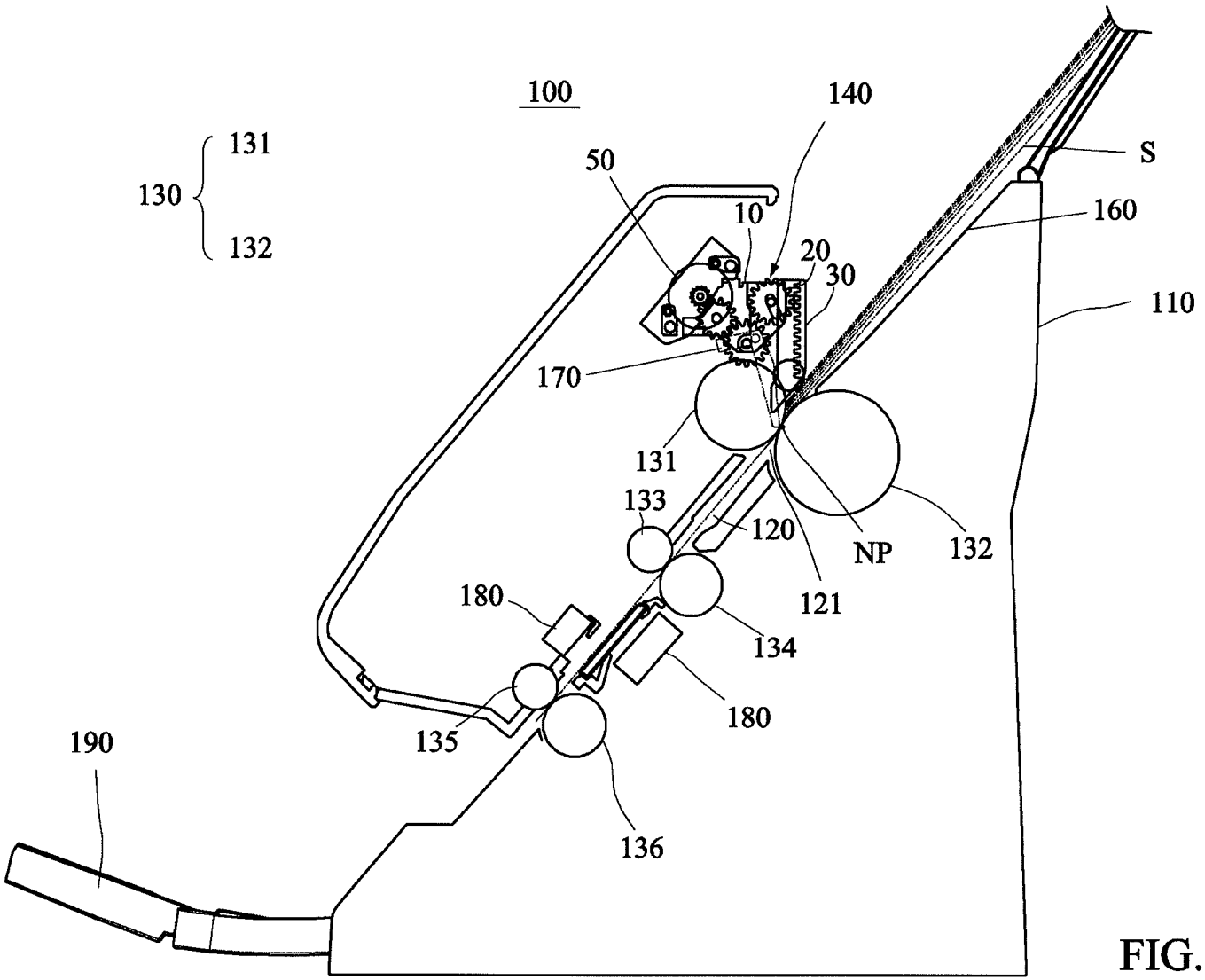
FIGS. 1 and 2 are schematic illustrations of two states of an automatic feeding apparatus according to a preferred embodiment of the present invention.
Figure 2:
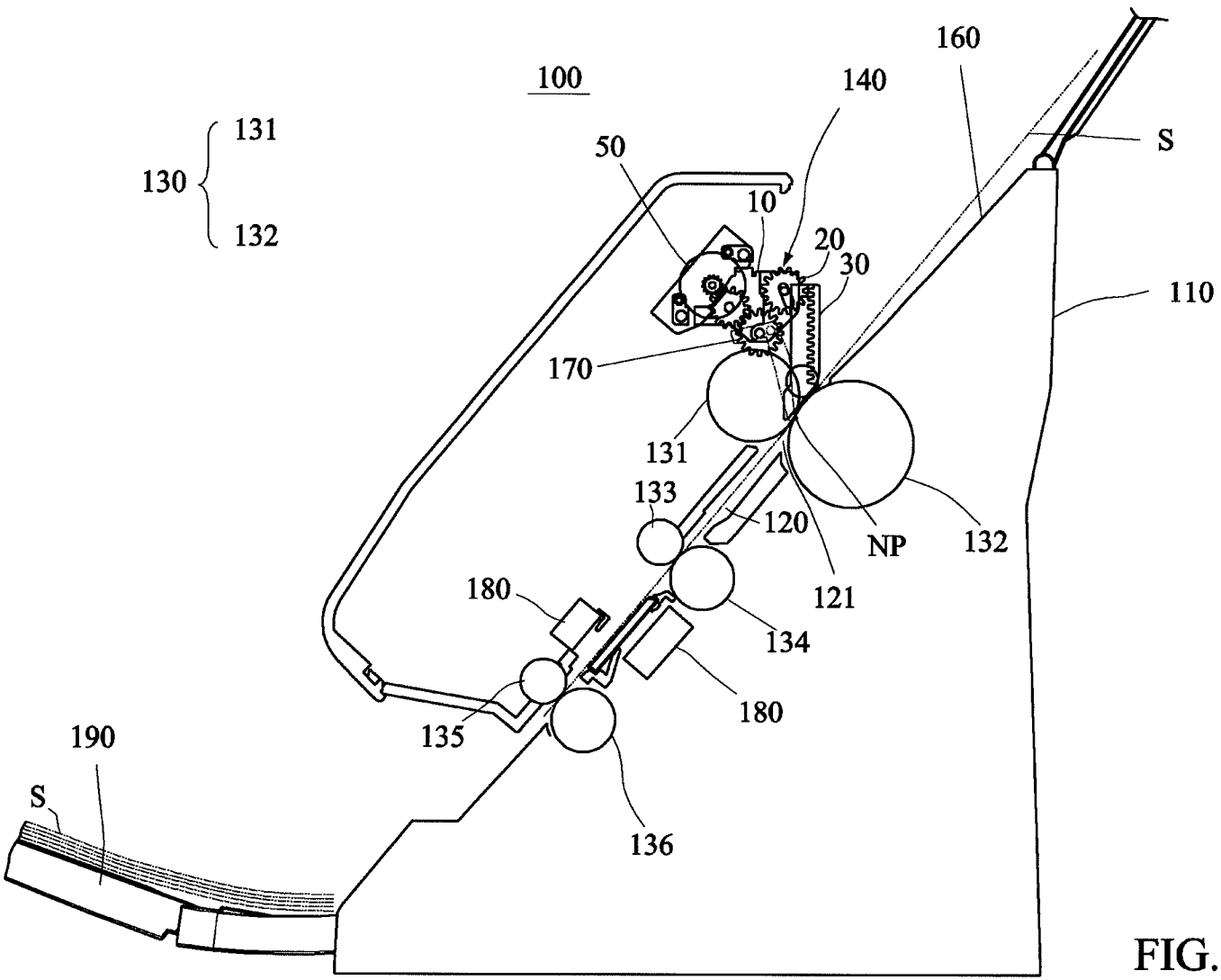
Figure 3:
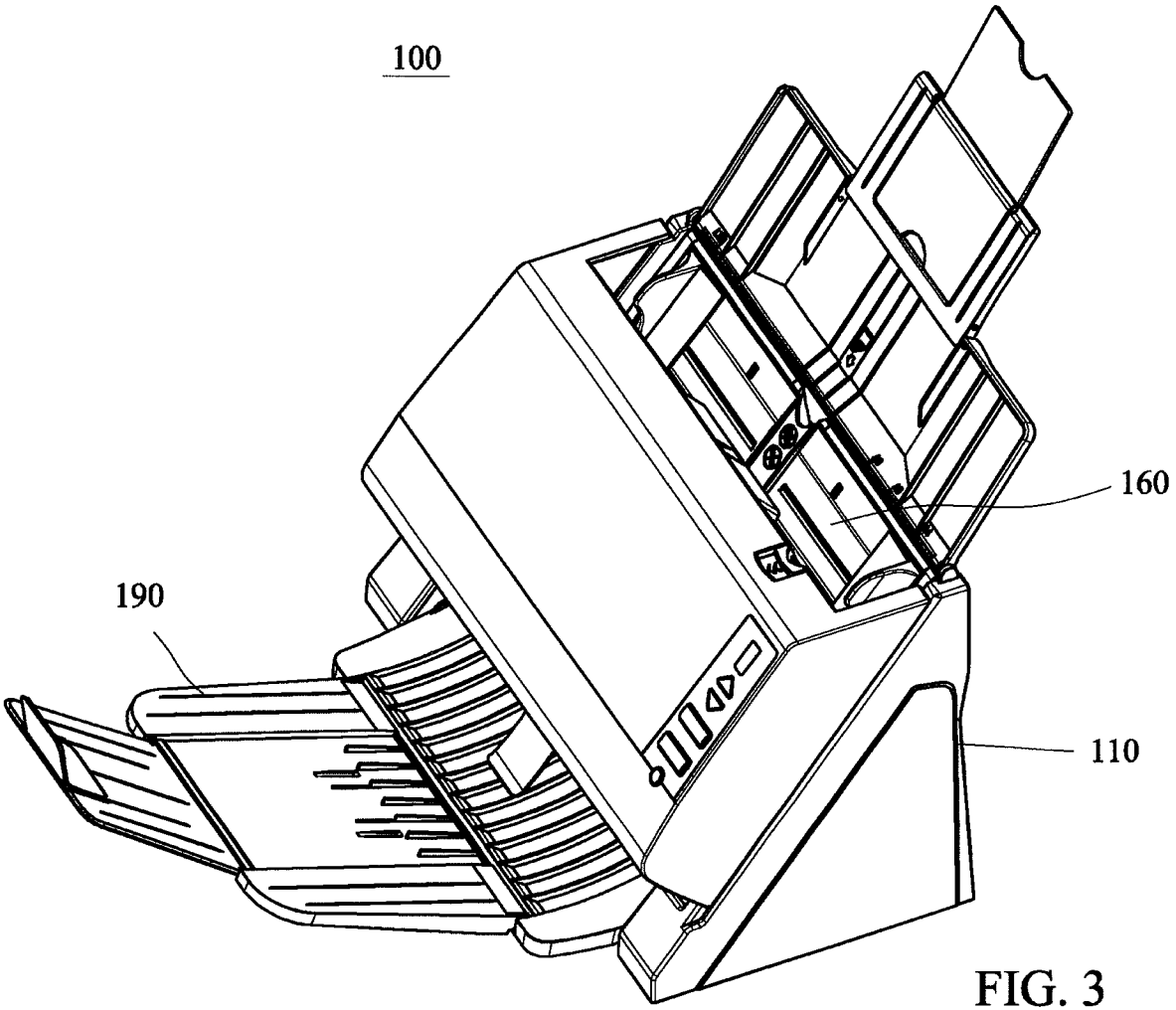
FIGS. 3 and 4 are pictorial views of the automatic feeding apparatus according to the preferred embodiment of the present invention.
Figure 4:
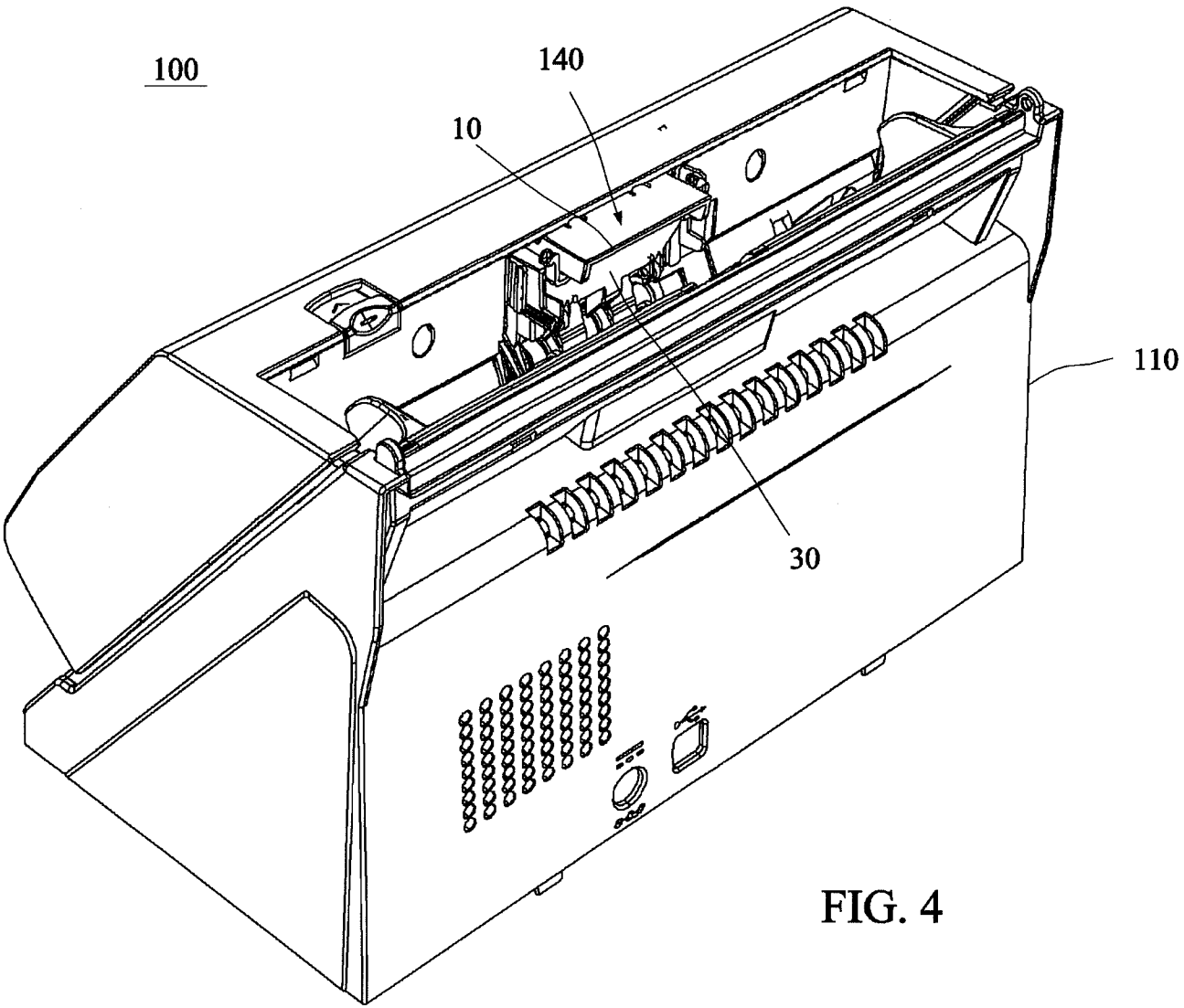

FIGS. 1 and 2 are schematic illustrations of two states of an automatic feeding apparatus 100 according to a preferred embodiment of the present invention. FIGS. 3 and 4 are pictorial views of the automatic feeding apparatus 100 according to the preferred embodiment of the present invention. Referring to FIGS. 1 to 4, the automatic feeding apparatus 100 of this embodiment includes a body 110, a sheet passage 120, a sheet-separation mechanism 130, a sheet-input assisting mechanism 140, a supporting plate 160, a sheet sensor 170, scanning modules 180 and a discharge tray 190.

The sheet passage 120 formed in the body 110 is connected to the supporting plate 160 and the discharge tray 190 that hold the sheet S. The sheet S is fed from the supporting plate 160 and delivered to the discharge tray 190 through the sheet passage 120. The sheet sensor 170 is disposed close to the sheet-separation mechanism 130. The sheet sensor 170 is used to detect any presence of the sheet S on the supporting plate 160. In this embodiment, the sheet sensor 170 is a lever arm reed sensor. The sheet-separation mechanism 130 is disposed at an entrance 121 of the sheet passage 120. The sheet-separation mechanism 130 includes a separation member 131 (a separation roller in FIG. 1) and a sheet-input roller 132 cooperating with each other to separate the sheets S and feed the sheets S into the sheet passage 120 one by one. A nip portion NP is formed between the separation roller 131 and the sheet-input roller 132. The sheet-input roller 132 is configured to feed the sheet S through the nip portion NP and cooperates with the separation roller 131 to perform sheet-separation at the nip portion NP. The sheet S entering the sheet passage 120 is transported by rollers 133 and 134 and scanned by the scanning modules 180 disposed in the sheet passage 120. The number of the scanning module(s) 180 is not particularly limited to one or two. The scanned sheet S is eventually transported by rollers 135 and 136 to the discharge tray 190. FIG. 1. shows the state of the sheet-input assisting mechanism 140 when a plurality of sheets S is loaded on the supporting plate 160; and FIG. 2 shows another state of the sheet-input assisting mechanism 140 when only one single sheet S is left on the supporting plate 160.

Figure 7:
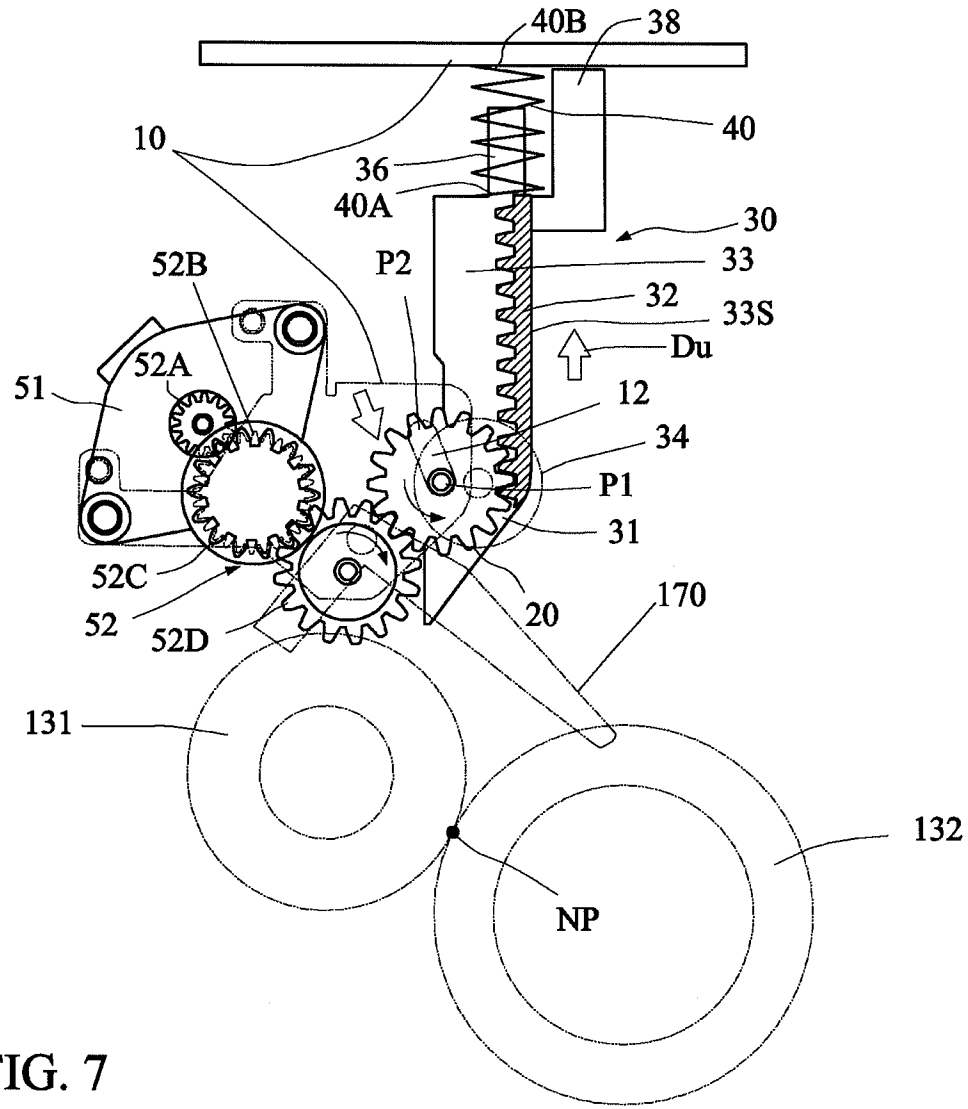
FIG. 7 is a schematic illustration of a sheet-input assisting mechanism in a non-pressing state.

The sheet-input assisting mechanism 140 disposed in the body 110 includes a frame 10, a presser 30, a clutch gear 20 and a driving device 50. The presser 30 is mounted on the frame 10. The presser 30, used to press the sheet S in front of the nip portion NP, includes a holder 33 and a gear rack 32 mounted on a side wall 33S of the holder 33, as shown in FIG. 7. The presser 30 presses the sheet S against the sheet-input roller 132 as the sheet S is fed by the sheet-input roller 132.

In FIG. 1, the sheets S are placed on the supporting plate 160, and the presser 30 presses these sheets S. When the sheets S are fed into the sheet passage 120 one by one, the number of sheets S on the supporting plate 160 is gradually decreased. According to the present invention, even if only a single sheet S is left, the presser 30 still presses the single sheet S against the sheet-input roller 132, as shown in FIG. 2. In other words, the presser 30 is automatically adjustable in height and adaptable to variation in amount of the sheets S loaded on the supporting plate 160.

Figure 5:
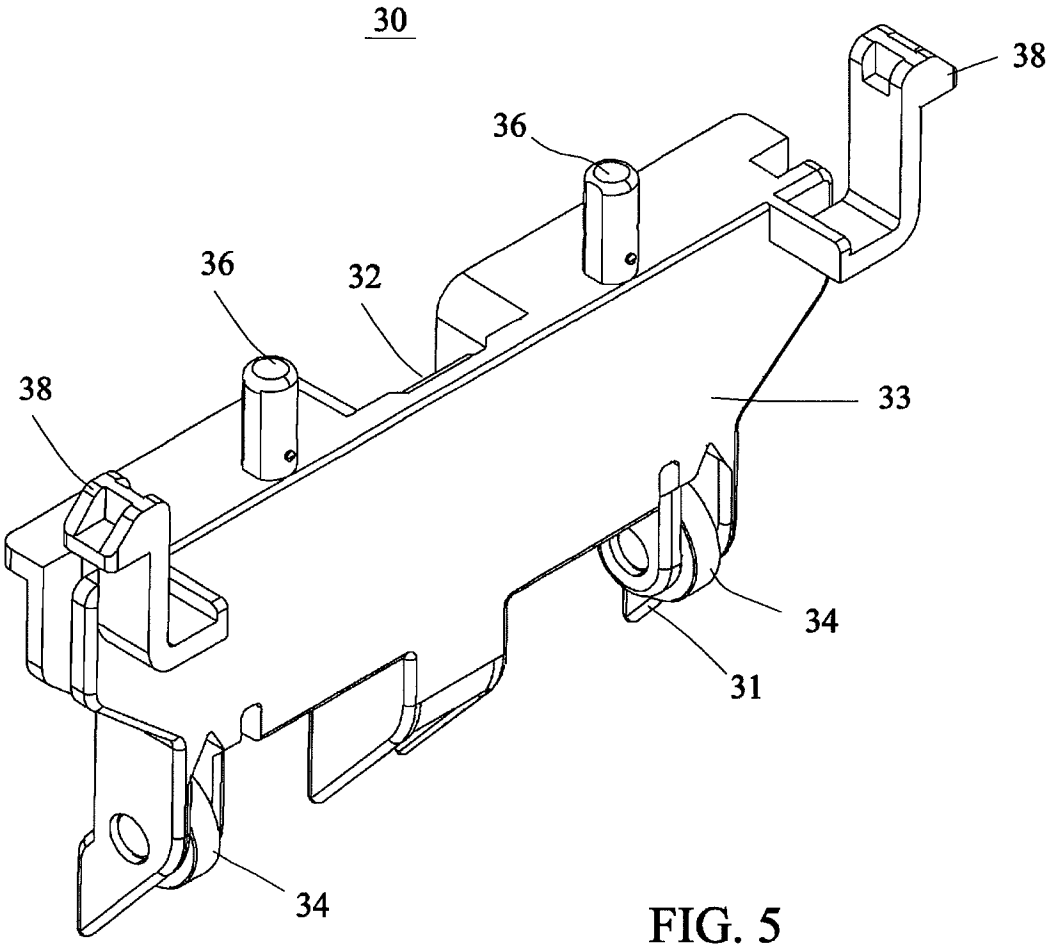
FIG. 5 is a pictorial view of a presser.
Figure 6:
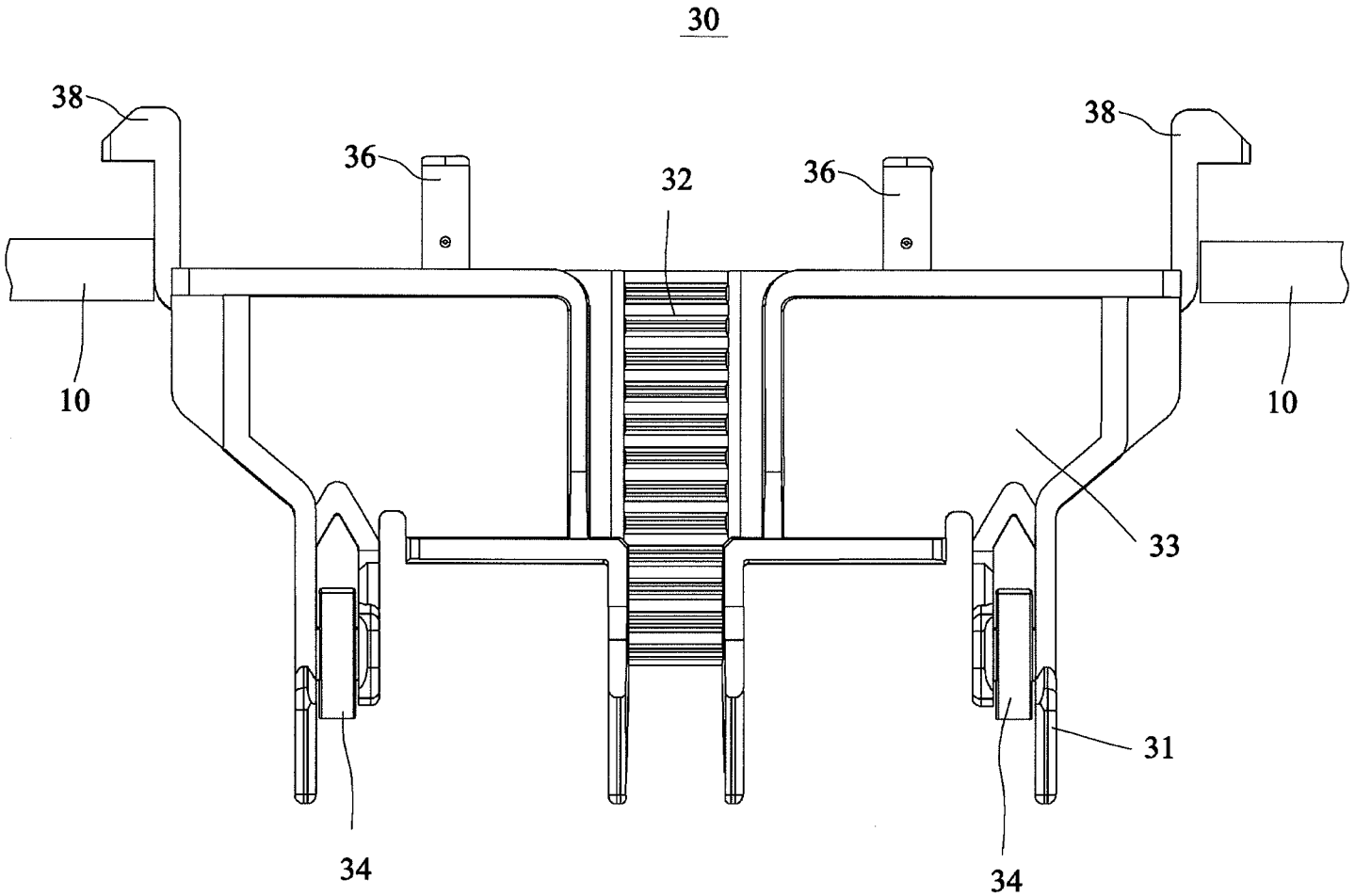
FIG. 6 is another schematic illustration of the presser of FIG. 5.

FIG. 5 is a pictorial view of the presser 30. FIG. 6 is another schematic illustration of the presser 30 of FIG. 5 to show a gear rack 32 of the presser 30. As shown in FIGS. 5 and 6, in addition to the gear rack 32 and the holder 33, the presser 30 further comprises two pressing rollers 34, two posts 36 and two hooks 38 attached to the holder 33. The pressing rollers 34 are disposed side by side at ends 31 of the holder 33 and abut against the sheet S when the presser 30 is in the position to press the sheet S. The hook 38 hooks on the frame 10, which allows the presser 30 to move vertically in relation to the frame 10.

Figure 8:
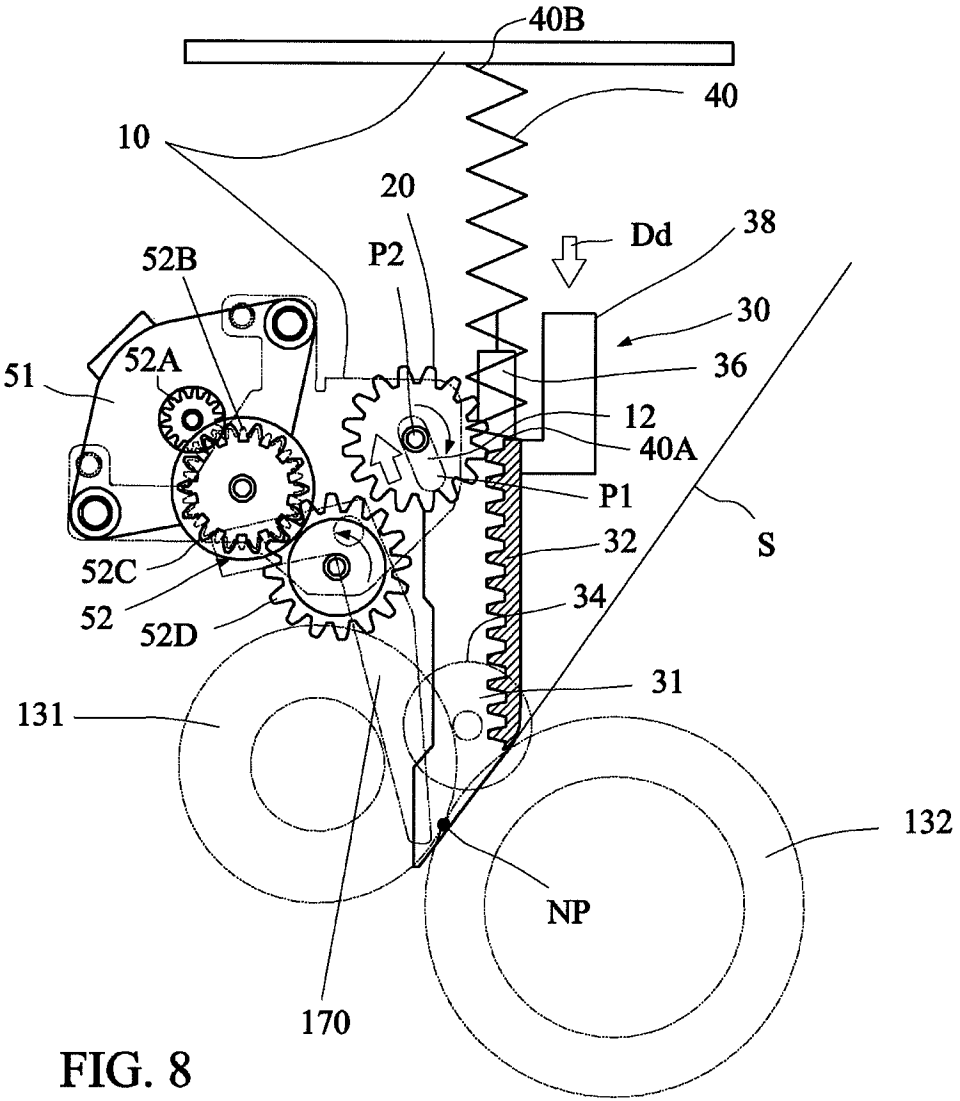
FIG. 8 is a schematic illustration of the sheet-input assisting mechanism in a pressing state.

FIGS. 7 and 8 are schematic illustrations of the sheet-input assisting mechanism 140 in a non-pressing state and a pressing state, respectively. As shown in FIGS. 7 and 8, the clutch gear 20 is supported and displaceable on a guide groove 12 of the frame 10. The guide groove 12 is elongate, and the clutch gear 20 is configured to move within the guide groove 12 between a first position P1 and a second position P2. The clutch gear 20 drives the presser 30 to move up and down by engaging and disengaging the gear rack 32 of the presser 30. In this embodiment, the guide groove 12 is slanted with the left end up to establish that a shortest distance between the first position P1 and the gear rack 32 is shorter than a shortest distance between the second position P2 and the gear rack 32. However, the guide groove 12 may be formed in any shape or at any angle, as long as in result, the clutch gear 20 is engaged with the gear rack 32 in one position and disengaged therefrom after moving into another position on the guide groove 12.

The driving device 50 selectively drives the clutch gear 20 to rotate forward and rearward. As shown in FIG. 7, the clutch gear 20 when rotating rearward (counterclockwise) is engaged with the gear rack 32 at the first position P1 and drives the presser 30 to move in a first direction Du (in the upward direction) away from the sheet-input roller 132 and the supporting plate 160. As shown in FIG. 8, the clutch gear 20 when rotating forward (clockwise) is shifted to the second position P2 and disengaged from the gear rack 32. In this case, the presser 30, after being released by the clutch gear 20, moves in a second direction Dd (i.e., descending towards the sheet-input roller 132 and the supporting plate 160) to press the sheets S in front of or upstream of the nip portion NP of the sheet-separation mechanism 130. In this embodiment, although the second direction Dd is a reverse direction with respect to the first direction Du, the present invention is not limited thereto. In another embodiment, for example, the presser 30 may be arranged to move in directions at a obtuse angle, which in turn, also achieves the same results of moving the presser 30 away from the sheet-input roller 132 or upon the sheets S.

For the purpose of smooth loading of the sheets S on the supporting plate 160 and onto the sheet-input roller 132, the presser 30 is raised to the top (i.e., spaced apart from the sheet-input roller 132) when the automatic feeding apparatus 100 is in the standby state, as shown in FIG. 7. When the sheet sensor 170 detects the presence of the sheet S (i.e., the lever arm of the sheet sensor 170 is pushed by the sheet S, as shown in the transition from FIG. 7 to FIG. 8), the driving device 50 drives the clutch gear 20 to rotate forward, and the clutch gear 20 is thereby disengaged from the gear rack 32 of the presser 30. The presser 30 moves in the second direction Dd and further puts pressure on the sheet S. In this embodiment, two pressing rollers 34 of the presser 30 press the sheet S against the sheet-input roller 132.

After the sheets S placed on the supporting plate 160 have all been fed into the sheet passage 120 through the nip portion NP or when the user removes all the sheets S from the supporting plate 160, the sheet sensor 170 detects the absence of the sheet, and the driving device 50 after being triggered drives the clutch gear 20 to rotate rearward to move the presser 30 in the first direction Du and away from the sheet-input roller 132, so that the user can place another sets of documents on the supporting plate 160.

The presser 30 further includes a compression spring or compression springs 40 for increasing the suppressing force on the sheet S. The compression spring 40 has one end 40A mounted on the holder 33 and the other end 40B connected to the frame 10. The compression spring 40 when loaded with energy exerts a force on the holder 33 to put more pressure on the sheet S. In this embodiment, the post 36 is disposed on top of the holder 33. The compression spring 40 is mounted and sleeved on the post 36, and the two ends 40A and 40B of the compression spring 40 push against the presser 30 and the frame 10, respectively. When the presser 30 is driven by the clutch gear 20 to move in the first direction Du, the compression spring 40 is compressed and stores energy, which is converted into the supplementary suppressing force on the sheet S.

As shown in FIGS. 7 and 8, the driving device 50 includes a motor 51 and a gear train 52. The motor 51 is mounted on the frame 10. The gear train 52 is rotatably disposed on the frame 10, for example, is coupled to the motor 51 and the clutch gear 20, and transmits the power of the motor 51 to the clutch gear 20. The gear train 52 includes member gears 52A, 52B, 52C and 52D. The member gear 52A is mounted on the rotating shaft of the motor 51. The member gear 52B is engaged with the member gear 52A and disposed coaxially with the member gear 52C. The member gear 52C is engaged with the member gear 52D, and the member gear 52D is engaged with the clutch gear 20. The forward rotation and the reverse rotation of the member gear 52D drive the clutch gear 20 to rotate rearward and forward, respectively. It is to be noted that the number of gears of the gear train 52 is not limited to 4, and the gear train 52 may only contain a single gear.

The present invention utilizes the motor and gear-rack transmission assembly to drive the presser. The reverse rotation of the clutch gear lifts up the presser from the position where the presser presses the sheets. On the other hand, the forward rotation of the clutch gear enables the clutch gear to slide to the position, where the clutch gear is disengaged from the gear rack, along the guide groove to press the document. In addition, the energy released by the compression spring is utilized to increase the suppressing force exerted by the presser on the sheets, so that the presser is pressing the sheets on the supporting plate with adequate pressures.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An automatic feeding apparatus, comprising:

a body;

a sheet passage formed in the body;

a sheet-separation mechanism, disposed in the body and at an entrance of the sheet passage, for sheet separation, the sheet-separation mechanism forming a nip portion; and a sheet-input assisting mechanism disposed in the body and comprising:

a frame;

a presser, mounted on the frame, for pressing a sheet in front of the nip portion, the presser comprising a holder and a gear rack mounted on a side wall of the holder;

a clutch gear, supported and displaceable on a guide groove of the frame, wherein the clutch gear is configured to move within the guide groove between a first position and a second position; and a driving device for selectively driving the clutch gear to rotate forward and rearward, wherein:

the clutch gear when rotating rearward is engaged with the gear rack at the first position and drives the presser to move in a first direction; and the clutch gear when rotating forward is shifted to the second position and disengaged from the gear rack, wherein the presser, after being released by the clutch gear, moves in a second direction to press the sheet.

2. The automatic feeding apparatus according to claim 1, wherein:

the body comprises a supporting plate for holding the sheet; and the automatic feeding apparatus further comprises a sheet sensor for detecting presence of the sheet on the supporting plate, wherein:

upon detection of presence of the sheet, the driving device drives the clutch gear to rotate forward; and upon detection of absence of the sheet, the driving device drives the clutch gear to rotate rearward.

3. The automatic feeding apparatus according to claim 1, wherein the presser further comprises a pressing roller disposed at one end of the holder, for abutting against the sheet.

4. The automatic feeding apparatus according to claim 1, wherein the guide groove is elongate.

5. The automatic feeding apparatus according to claim 1, wherein the presser further comprises:

a compression spring having one end mounted on the holder and the other end connected to the frame, wherein the compression spring when loaded with energy exerts a force on the holder to assist the presser in pressing the sheet.

6. The automatic feeding apparatus according to claim 5, wherein the presser further comprises a post disposed on the holder for mounting of the compression spring.

7. The automatic feeding apparatus according to claim 1, wherein the driving device comprises:

a motor; and a gear train, coupled to the motor and the clutch gear, for transmitting power of the motor to the clutch gear.

8. The automatic feeding apparatus according to claim 7, wherein a member gear of the gear train is engaged with the clutch gear, wherein forward rotation and reverse rotation of the member gear drive the clutch gear to rotate rearward and forward, respectively.

9. The automatic feeding apparatus according to claim 1, wherein the sheet-separation mechanism comprises a sheet-input roller configured to feed the sheet through the nip portion, and a separation member forming the nip portion together with the sheet-input roller, wherein the presser presses the sheet against the sheet-input roller as the sheet is fed by the sheet-input roller.

10. The automatic feeding apparatus according to claim 1, further comprising:

a scanning module, disposed in the sheet passage, for scanning an image of the sheet transported in the sheet passage.

11. The automatic feeding apparatus according to claim 1, wherein a shortest distance between the first position and the gear rack is shorter than a shortest distance between the second position and the gear rack.

* * * * *